United States Patent [19]

Ishikawa et al.

[11] 4,433,669

[45] Feb. 28, 1984

[54] PLASMA IGNITION SYSTEM FOR AN INTERNAL COMBUSTION ENGINE

[75] Inventors: Yasuki Ishikawa; Hiroshi Endo, both of Yokosuka; Masazumi Sone, Tokyo; Iwao Imai, Yokosuka, all of Japan

[73] Assignee: Nissan Motor Company, Limited, Kanagawa, Japan

[21] Appl. No.: 386,781

[22] Filed: Jun. 7, 1982

[30] Foreign Application Priority Data

Jun. 12, 1981 [JP] Japan ..... 56-85523

[51] Int. Cl.[3] ..... F02P 15/00

[52] U.S. Cl. ..... 123/620; 123/643; 123/605; 123/146.5 A

[58] Field of Search ..... 123/143 B, 620, 643, 123/605, 596, 598, 146.5 A

[56] References Cited

U.S. PATENT DOCUMENTS

| | | | |
|---|---|---|---|
| 3,788,293 | 1/1974 | Anderson | 123/620 |
| 4,122,816 | 10/1978 | Fitzgerald et al. | 123/598 |
| 4,301,782 | 11/1981 | Wainwright | 123/620 |
| 4,366,801 | 1/1983 | Endo et al. | 123/620 |
| 4,369,757 | 1/1983 | Anzai | 123/620 |

FOREIGN PATENT DOCUMENTS

| | | | |
|---|---|---|---|
| 1371042 | 10/1974 | United Kingdom | 123/605 |

*Primary Examiner*—Charles J. Myhre
*Assistant Examiner*—Andrew M. Dolinar
*Attorney, Agent, or Firm*—Lowe, King, Price & Becker

[57] ABSTRACT

A plasma ignition system for an internal combustion engine having a plasma ignition plug within each of the engine cylinders, which comprises: (a) a low DC voltage supply such as a vehicle battery; (b) a high surge voltage generator which generates and distributes a high surge voltage having a negative peak value of about minus 15 kilovolts into one of the plasma ignition plugs according to a predetermined ignition order so as to generate a spark discharge at the plasma ignition plug; (c) a DC-DC converter which boosts the low DC voltage sent from the low DC voltage supply to a high DC voltage; (d) a plurality of plasma ignition energy charging means each of which charges the high DC voltage supplied from the DC-DC converter; (e) a plurality of thyristors each for connecting the plasma ignition energy charging means to the corresponding plasma ignition energy charging means to the corresponding plasma ignition plug in response to a first trigger signal applied thereat; (f) a trigger signal generator which generates and outputs the first trigger signal into the gate terminal of one of the thyristors according to the predetermined ignition order so as to turn on said thyristor and a second trigger signal for halting the high DC voltage from outputting from the DC-DC converter; (g) a plurality of inductors for producing an oscillation on a basis of the high DC voltage outputted from the corresponding plasma ignition energy charging means; and (h) a high DC voltage charging and discharging means for extending the turn-on interval of one of the thyristors which is triggered by the first trigger signal from the trigger signal generator, whereby the plasma ignition always occurs without misfire.

5 Claims, 7 Drawing Figures

PLASMA IGNITION SYSTEM FOR AN INTERNAL COMBUSTION ENGINE

BACKGROUND OF THE INVENTION (1) Field of the Invention

The present invention relates to a plasma ignition system for an internal combustion engine, and specifically to the plasma ignition system wherein an auxiliary circuit serving as a timer is provided at a plasma ignition energy charging means to keep each of thyristors as a switching circuit element for operatively connecting the plasma ignition energy charging means to a corresponding coil and plasma ignition plug in which a spark discharge has been generated by means of a high surge voltage generating and distributing means turned on during a predetermined interval of time after each thyristor is turned on in response to an ignition timing pulse applied thereat and one of the thyristors and the plasma ignition energy charging means is provided for each engine cylinder, so that a favorable plasma ignition can be made even when the voltage drop from a negatively high voltage toward a zero voltage is slow due to an excessive rise in temperature within a discharge gap of each plasma ignition plug and an unmatched discharge occurring at an irregular ignition timing can be prevented.

(2) Description of the Prior Art

A plasma jet ignition system has been developed as a means for providing a positive ignition and more stable combustion of air-fuel mixture without misfire under various engine operating conditions such as light load condition of unstable combustion with a lean air-fuel mixture.

A conventional plasma ignition system comprises: (a) a low DC voltage supply such as a vehicle battery; (b) a transformer having a primary winding connected to the battery and a secondary winding one terminal of which being connected to the primary winding as a common terminal; (c) a contact breaker incorporated between the common terminal of the transformer and ground which turns on and off repetitively in synchronization with the engine rotation so as to generate a considerably high surge voltage at the secondary winding of the transformer; (d) a mechanical distributor having a rotor which rotates in synchronization with the engine rotation and a plurality of contacts, each located at a fixed interval of distance from other two adjacent contacts and each of which circularly comes in contact with the rotor as the rotor rotates with the engine; (e) a plurality of plasma ignition plugs each mounted within a corresponding combustion chamber of engine cylinder; (f) a trigger pulse generator connected to the common terminal of the transformer which receives serial inductive voltage surge pulses which appear at the common terminal of the transformer and shapes the voltage surge pulses; (g) a thyristor whose gate terminal is connected to the trigger pulse generator and which turns on in response to each of the shaped voltage pulses from the trigger pulse generator; (h) a DC-DC converter which boosts the low DC voltage from the battery to a high DC voltage; (i) a capacitor connected to the DC-DC converter for charging the high DC voltage outputted from the DC-DC converter; (j) a first diode connected to one end of the capacitor which conducts the end of the capacitor to ground when the capacitor charges the high DC voltage from the DC-DC converter and which renders the end of the capacitor float with respect to the ground when the thyristor turns on to ground the other end of the capacitor so as to connect the capacitor to one of the plasma ignition plugs in which the spark discharge has occurred; and (k) a plurality of second diodes each connected between the capacitor and corresponding plasma ignition plug for preventing the current flow due to the spark discharge into the capacitor.

When the repetitive switching operation of the contact breaker causes the interruption of an electric current flowing through the primary winding of the transformer, the secondary winding of the transformer produces an excessively high surge voltage having a peak value of −20 through −30 kilovolts with respect to ground potential. This high-peak voltage is supplied into the distributor so that the respective plasma ignition plugs sequencially receive the high-peak voltage via respective high tension cables having high-frequency resistance characteristics.

At this time, each plasma ignition plug generates a spark discharge at a gap between side and central electrodes thereof so that the side and central electrodes substantially conduct each other.

On the other hand, one ignition pulse shaped by the trigger pulse generator turns on the thyristor at each interval of time, so that the high DC voltage charged within the capacitor is fed into one of the plasma ignition plugs where the spark discharge has already occurred via the thyristor and corresponding second diode. Therefore, the plasma ignition plug generates a high-temperature plasma gas and injects the gas into the corresponding combustion chamber to perform a complete combustion of the air-fuel mixture supplied thereinto.

However, there is a problem in the conventional plasma ignition system that in the case when the drop in the voltage across the two electrodes of each plasma ignition plug from a negatively high voltage toward a zero voltage is considerably slow due to an excessive rise in temperature of the gap between both two electrodes (the excessive rise in temperature described above is chiefly caused by the repetitive plasma ignition operations). Therefore, the thyristor turns on in response to the ignition trigger pulse from the ignition pulse generator with the voltage across the gap between both two electrodes of one of the plasma ignition plugs in which the spark discharge has occurred being kept still at a relatively negative high voltage for a long interval of time. Consequently, the thyristor cannot feed the plasma ignition energy charged within the capacitor into the plasma ignition plug to generate the plasma gas thereat for the interval of time described above so that an electric current that holds the thyristor in the turned-on state does not flow through the thyristor on condition that the voltage (resistance) across the gap described above indicates a low minus voltage substantially equal to the voltage across the capacitor immediately after the thyristor turns on and thereby the thyristor returns immediately to the turned-off state.

Furthermore, there is another problem that, since a single set of thyristor and capacitor is used for all plasma ignition plugs in the conventional plasma ignition system, the terminal voltage across the capacitor when the thyristor is turned on is applied across all plasma ignition plugs so that any of the engine cylinders, e.g., in a suction stroke where the voltage across the two electrodes of the corresponding plasma ignition plug to start the spark discharge is relatively low with respect to the ground potential may introduce an unfavorable discharge, i.e., an unmatched discharge.

SUMMARY OF THE INVENTION

With the above-described problems in mind, it is an object of the present invention to provide a plasma ignition system for an internal combustion engine having any number of engine cylinders which achieves a favorable plasma ignition even under the excessively high temperature rise in plasma ignition plugs mounted within the respective engine cylinders and an elimination of the unmatched discharge which may occur at a timing except a regular ignition timing.

This can be achieved by providing a particular timer (charging and discharging circuit) which operatively sends a current into a thyristor which is turned on that exceeds the thyristor holding current to keep the thyristor turned on during a predetermined interval of time for feeding the ignition energy charged within the capacitor into the corresponding plasma ignition plug completely after the thyristor is turned on in response to an ignition trigger pulse received thereat from the trigger pulse generator, with a single set of the thyristor and capacitor provided for each engine cylinder.

BRIEF DESCRIPTION OF THE DRAWINGS

The features and advantages of the present invention will be appreciated from the following description and accompanied drawings in which like reference numerals designate corresponding elements and in which.

DETAILED DESCRIPTION OF THE PREFERRED EMBODIMENTS

Reference will hereinafter be made to the drawings and first to FIG. 1 which shows longitudinally sectioned and bottom views of a plasma ignition plug.

Figure 1:
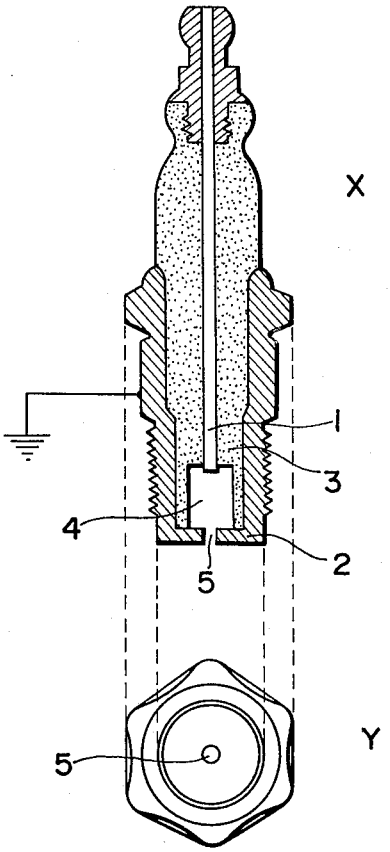
FIG. 1 shows an example of a plasma ignition plug to be mounted within an engine cylinder.

In FIG. 1, numeral 1 denotes a central electrode, made of, e.g., tungsten and numeral 2 denotes a side electrode provided so as to enclose the central electrode 1.

An electrical insulating member 3 made of, e.g., ceramics is sandwiched between the central and side electrode 1 and 2. Furthermore, a discharge cavity 4 is formed at a top end of the central electrode 1 so that the top end of the central electrode 1 faces against a wall of the side electrode 2 and a jet hole 5 is provided at a center of the wall of the side electrode 2 so as to communicate the discharge cavity 4 with an external medium, i.e., compressed air-fuel mixture supplied into a combustion chamber of each engine cylinder. Therefore, the potential difference (resistance) becomes substantially zero between the central and side electrodes 1 and 2 due to an electric breakdown when a spark discharge occurs at the discharge cavity 4 in response to a high ignition impulse and thereafter a high-temperature plasma flame gas occurs at the discharge cavity 4 subsequent to the spark discharge in response to a high ignition energy supplied therebetween. Consequently, the high-temperature plasma gas is injected into the corresponding chamber through the jet hole 5 so as to ignite air-fuel mixture. It should be noted that the side electrode 2 is grounded.

Figure 2:
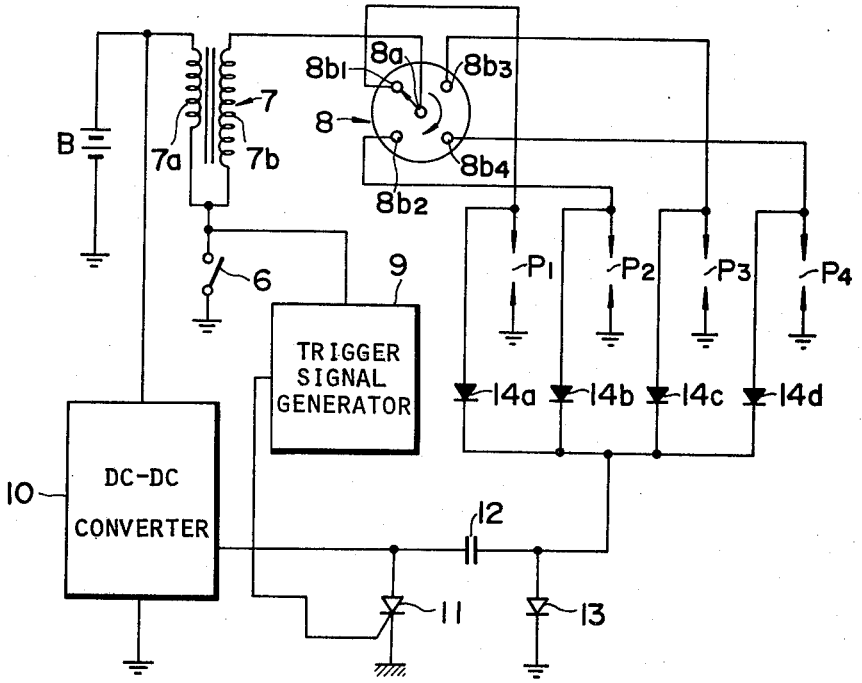
FIG. 2 PRIOR ART
FIG. 2 shows a circuit diagram of a conventional plasma ignition system wherein a plurality of plasma ignition plugs as shown in FIG. 1 are used.

FIG. 2 shows an overall circuit configuration of a conventional plasma ignition system for a four-cylinder engine.

In FIG. 2, symbol B denotes a low DC voltage source such as a vehicle battery and symbols $P_1$ through $P_4$ denotes plasma ignition plugs of such constructions as shown representatively in FIG. 1, each mounted within a corresponding numbered engine cylinder. Numeral 6 denotes a contact breaker which repetitively turns on and off in synchronization with the rotation of the engine. Numeral 7 denotes a transformer having a common terminal of both primary and secondary windings 7*a* and 7*b* connected to ground via the contact breaker 6. Numeral 8 denotes a mechanical distributor having a rotor 8*a* connected to the secondary winding 7*b* of the transformer 7 rotating in synchronization with the rotation of engine and four fixed contacts $8b_1$ through $8b_4$ each being connected to the central electrode 1 of the corresponding plasma ignition plug $P_1$ through $P_4$. The interval of distance between each fixed contact $8b_1$ through $8b_4$ is equal so as to take an appropriate contact timing between the rotor 8*a* and one of the fixed contacts 8*b*. Numeral 9 denotes a trigger pulse generator which receives an inductive surge voltage pulse generated whenever the contact breaker 6 is open and shapes it into a rectangular voltage pulse. Numeral 10 denotes a DC-DC converter which boosts a low DC voltage from the battery B to a high DC voltage by inverting the low DC voltage into a corresponding AC voltage through an oscillation action and converting the AC voltage into the high DC voltage through a transformer and rectifying circuit each incorporated thereinto. Numeral 11 denotes a thyristor (abbreviation for a reverse-blocked triode thyristor) whose gate terminal is connected to the trigger pulse generator 9. Numeral 12 denotes a capacitor and numeral 13 denotes a first diode. One end of the capacitor 12 is connected to the DC-DC converter 10 and anode terminal of the thyristor 11 and the other end thereof is connected to the anode of the first diode 13 and to the central electrodes 1 of the plasma ignition plugs $P_1$ through $P_4$ via respective second diodes 14*a* through 14*d*. It is seen that one end of the contact breaker and cathode terminals of the thyristor 11 and first diode 13 are grounded.

A high surge voltage having a negative peak value of minus 20 through 30 kilovolts is induced at the secondary winding 7*b* of the transformer 7 due to the switching action of the contact breaker 6. The high surge voltage thus generated is sequencially applied across one of plasma ignition plugs $P_1$ through $P_4$ via the distributor 8 and a corresponding high tension cable according to an ignition color determined by the connection to the distributor 8. As shown in FIG. 2, the first plasma ignition plug $P_1$ receives the high surge voltage through the distributor 8 and generates a spark discharge between the central and side electrodes 1 and 2 so that the potential difference at the discharge cavity 4 between both central and side electrodes 1 and 2 becomes substantially zero. On the other hand, the trigger pulse signal produced from the generator 9 in synchronization with the rotation of the engine triggers the thyristor to turn on so that the end of the capacitor is grounded with the other end of the capacitor in a float state and the high DC voltage (1 through 2 kilovolts) charged within the capacitor is supplied into the first plasma ignition plug $P_1$ via the corresponding second diode 14*a* to generate the high-temperature plasma gas at the discharge cavity 4. It should be noted that a current does not flow into the capacitor via each second diode 14*a* through 14*d* since the voltage level at the secondary winding is negatively higher than that charged within the capacitor 12.

If the insulating resistance of the discharge cavity 4 does not become substantially zero in a short time, i.e., the potential difference across the discharge cavity 4 does not become equal to or positively higher than the voltage applied to the capacitor 12 upon the occurrence of the spark discharge while the thyristor 11 is turned on in response to the trigger pulse applied to the gate thereof at the substantially same timing as the spark discharge by the trigger pulse generator, a current that holds the thyristor 11 in the turned-on state does not flow through the thyristor 11 so that the thyristor 11 returns to the turned-off state and cannot supply the charged ignition energy within the capacitor 12 into the plasma ignition plug $P_1$ through $P_4$ in which the spark discharge has occurred.

FIG. 3 shows an overall configuration of a preferred embodiment of the plasma ignition system used for the four-cylinder engine according to the present invention. The battery B is, as shown in FIG. 3, connected with two circuitry: one being spark discharge generator which generates a spark discharge at each plasma ignition plug $P_1$ through $P_4$ by applying a negatively high-peak voltage across the electrodes of each plasma ignition plug $P_1$ through $P_4$; and the other being a plasma ignition circuit which generates and applies a high-energy electric charge into one of the plasma ignition plugs $P_1$ through $P_4$ at which the spark discharge has been generated so as to produce the plasma flame gas within the plasma ignition plug $P_1$ through $P_4$.

The former circuit comprises: (a) a transformer 7 having a primary winding 7*a* connected to the battery B and a secondary winding 7*b* of greater turns of windings than the primary winding 7*a*; (b) a contact breaker 6 connected between a common terminal of the transformer 7 and ground which repetitively turns on and off in synchronization with the rotation of the engine, i.e., which turns off whenever the engine rotates half (180°); and (c) a distributor 8 having a rotor 8*a* connected to the secondary winding 7*b* of the transformer 7 and four fixed contacts $8b_1$ through $8b_4$ each connected to the central electrode 1 of the corresponding plasma ignition plug $P_1$ through $P_4$. The construction and operation of each element is substantially the same as those of each element shown in FIG. 2.

Figure 4:
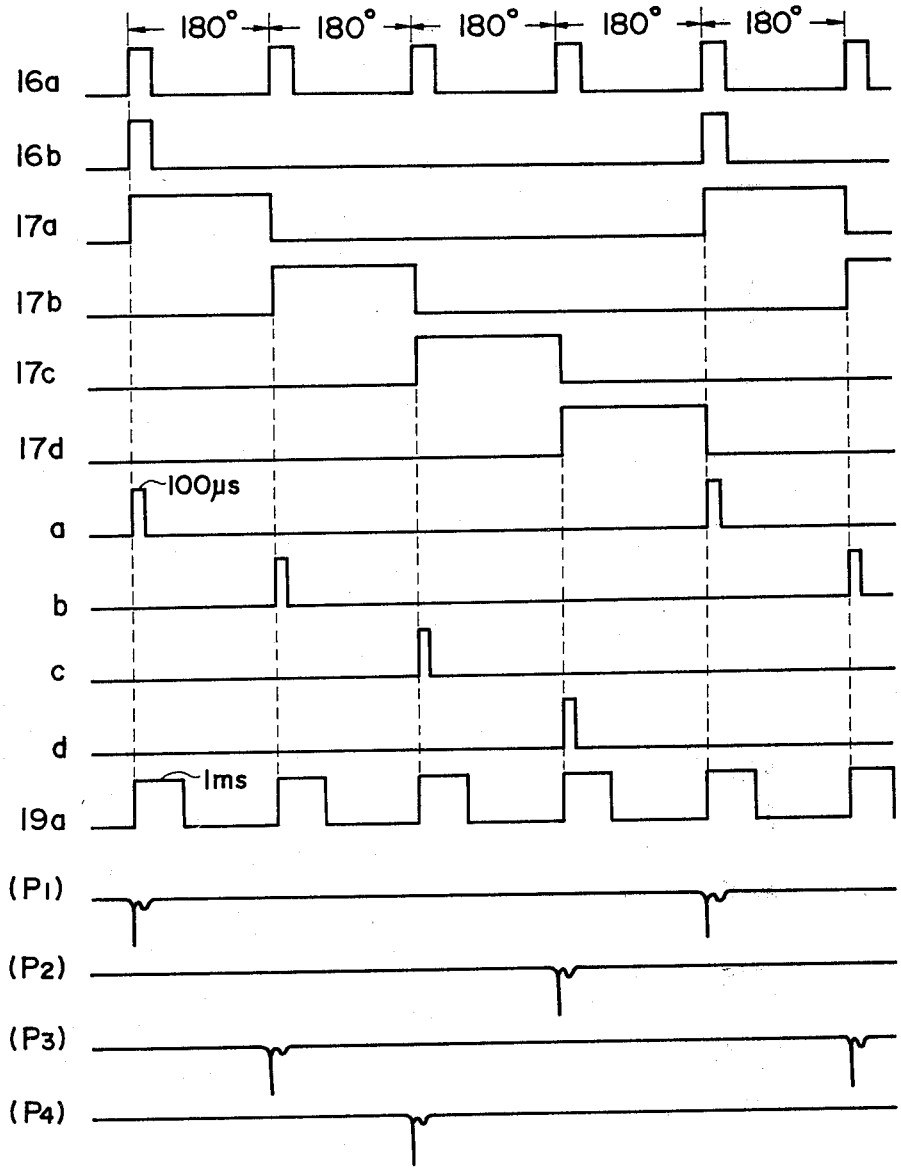
FIG. 4 shows a waveform timing chart of each output signal from each circuit shown in FIGS. 3(A) and 3(B)

The latter circuit comprises: (a) a DC-DC converter 10' which boosts the low DC voltage (12 volts) supplied from the battery B into the high DC voltage (Vo=1000 volts); (b) an auxiliary circuit 15 connected to the output terminal of the DC-DC converter having a third diode $D_3$, anode thereof being connected to the output terminal of the DC-DC converter 10', a fourth diode $D_4$, anode thereof being connected to the cathode of the third diode $D_3$, a first capacitor $C_2$, one end thereof connected to the cathode of the fourth diode $D_4$ and the other end grounded, and a resistor R connected across the fourth diode; (c) four fifth diodes $D_{1a}$ through $D_{5d}$ each anode connected to the anode of the third diode $D_3$ of the auxiliary circuit 15; (d) four second capacitors $C_2$, one end of each first capacitor $C_2$ connected to the anode of the corresponding fifth diodes $D_{5a}$ through $D_{5d}$; (e) four thyristors $S_1$ through $S_4$ whose anodes are connected to the corresponding cathode of the respective fifth diodes $D_{5a}$ through $D_{5d}$ and to the end of the respective second capacitors $C_2$ and cathodes are grounded; (f) four first diodes 13 whose anodes are connected to the other end of the respective second capacitors $C_2$ and cathodes are grounded; (g) four coils L each connected to the corresponding second capacitor $C_2$ at one end thereof; and (h) four second diodes 14*a* through 14*d* each connected between the corresponding coil L and central electrode of the corresponding plasma ignition plug $P_1$ through $P_4$. The latter circuit further comprises: (a) a crank angle sensor 16, which generates and outputs a crank angle pulse 16*a* whose period corresponds to a half rotation of the engine (180°) whenever the engine rotates one fourth of the engine cycle in the case of the four-cylinder engine and also outputs a engine cycle signal 16*b* whenever one engine cycle (720°) is ended. (the waveform of these two signals 16*a* and 16*b* are shown in FIG. 4); (b) a four-bit ring counter 17 which sequencially outputs a pulse signal 17*a* through 17*d* whenever the crank angle signal 16*a* is received, the width of the pulse signal 17*a* through 17*d* corresponding to 180° of the engine rotation as shown in FIG. 4, and is reset whenever the engine cycle signal 16*b* is received; (c) four first monostable multivibrators 18, each connected to the corresponding output terminal of the four-bit ring counter 17, each of which outputs a trigger pulse signal a through d of a predetermined pulsewidth, e.g., 100 microseconds whenever the corresponding pulse signal 17*a* through 17*d* is received from the four-bit ring counter 17, each trigger pulse signal a through d being sent into the corresponding thyristor 11*a* through 11*d* determined according to the ignition order of the engine cylinders, i.e., first, third, fourth, and second cylinders; and (d) a second monostable multivibrator 19 which outputs a pulse signal 19*a* whenever the crank angle signal 16*a* is received from the crank angle sensor 16 to the DC-DC converter 10', the pulse signal 19*a* having a predetermined width, e.g., 1 milisecond, so that the DC-DC converter 10' halts temporarily the output of the voltage Vo, i.e., its oscillation action during the reception of the pulse signal 19*a* from the second monostable multivibrator 19.

The operation of the plasma ignition system in the preferred embodiment is described hereinafter with reference to FIG. 4.

First, when the engine starts and the breaker contact 6 is opened and closed repetitively, a high-peak surge voltage generated at the secondary winding 7*b* of the transformer 7 is applied across one of the plasma ignition plugs $P_1$ through $P_4$ presently at the start of an explosion stroke of the corresponding cylinder via the distributor 8. The plasma ignition plug $P_1$ through $P_4$ described above generates a spark discharge between the central and side electrodes 1 and 2 and insulating breakdown occurs at the discharge cavity 4 shown in FIG. 1.

On the other hand, the four-bit ring counter 17 produces the pulse signals 17*a* through 17*d* at the same timing as the distributor 8 distributes the high-peak surge voltage into one of the plasma ignition plugs $P_1$ through $P_4$ and the respective first monostable multivibrators 18*a* through 18*d* outputs the pulse signals a through d sequencially into the respective gate terminals of the thyristors 11*a* through 11*d* in such a order as first the first thyristor 11*a*, second the third thyristor 11*d*, third the fourth thyristor 11*d*, and fourth the second thyristor 11*b*.

On the other hand, the DC-DC converter 10' boosts the low DC voltage from the battery B to the high DC voltage (Vo=1000 volts) and sends the high DC voltage into each second capacitor $C_2$ having a high voltage withstanding characteristic via the diodes $D_3$ and $D_{5a}$ through $D_{5d}$ for charging the high DC voltage within each second capacitor $C_2$ during an interval of time upon the completion of the oscillation halt by the halt signal 19*a* from the second monostable multivibrator 19 between each ignition timing of the engine cylinders and, also, at the same time, sends the high DC voltage into the first capacitor $C_1$ via the diodes $D_3$ and $D_4$ for charging the high DC voltage within the first capacitor $C_1$.

Figure 3A:
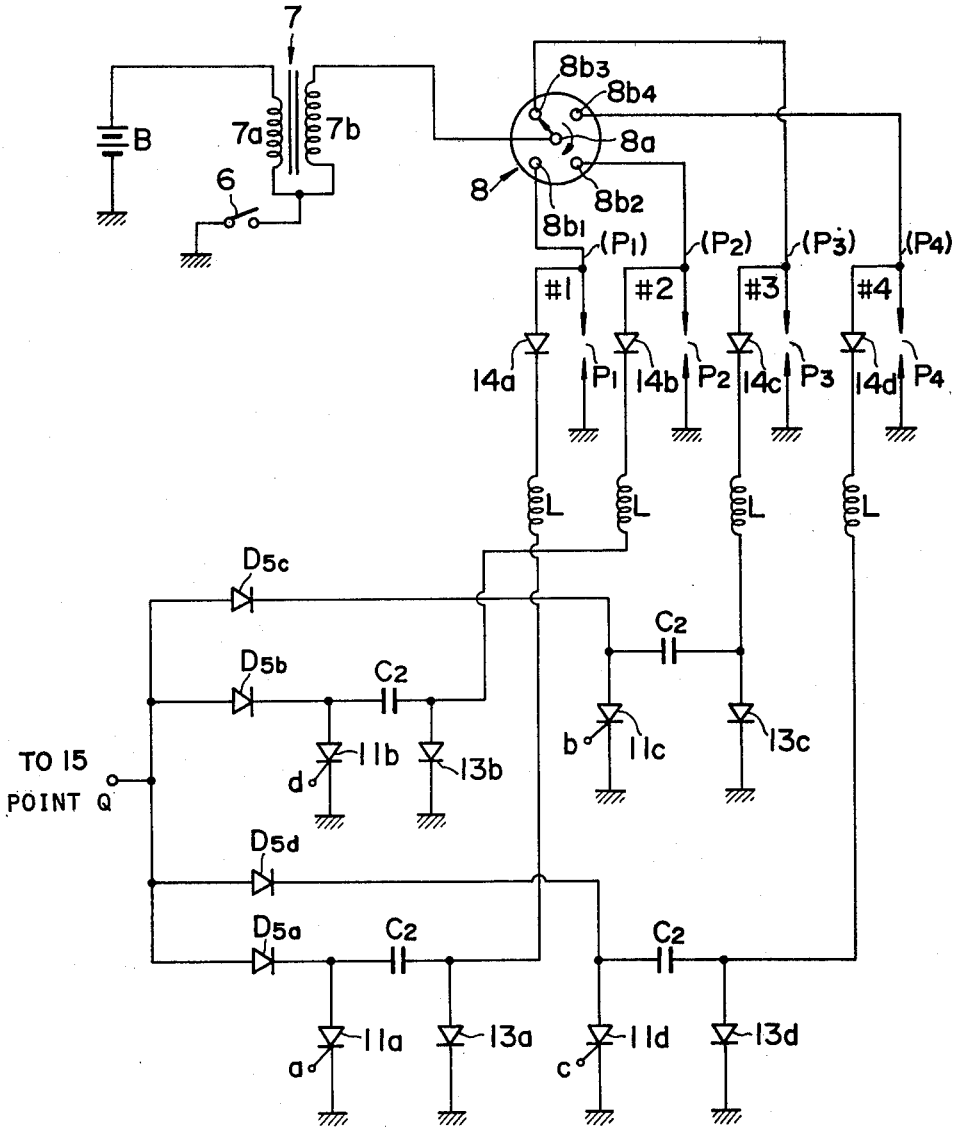
FIGS. 3(A) and 3(B) show a preferred embodiment of a plasma ignition system according to the present invention wherein the plasma ignition plugs as shown in FIG. 1 are mounted within the respective engine cylinders.
Figure 3B:
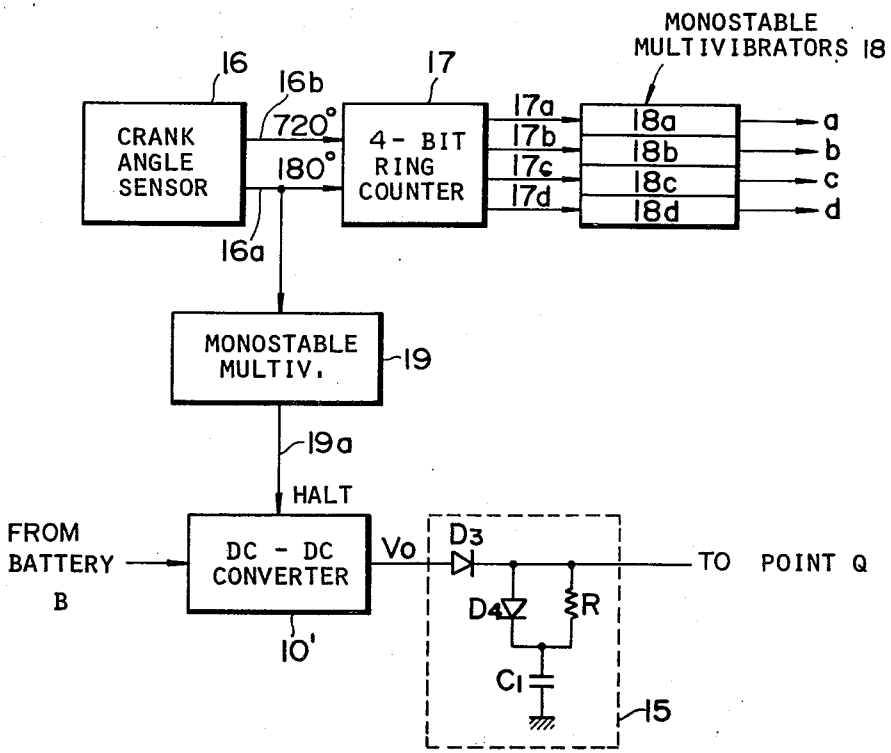

The subsequent operation of the plasma ignition system shown in FIGS. 3(A) and 3(B) is described hereinafter in relation to the first engine cylinder as a typical example.

Simultaneously when the spark discharge occurs at the first plasma ignition plug $P_1$ due to the application of the high-peak surge voltage generated at the secondary winding of the transformer 7 via the distributor 8 with the rotor 8*a* being in contact with the first fixed contact $8b_1$, the first thyristor 11*a* turns on in response to the trigger pulse signal a from the corresponding first monostable multivibrator 18*a* so that the corresponding second capacitor $C_2$ is electrically connected across the first plasma ignition plug $P_1$ via the corresponding second diode 14*a* and coil L so as to form a serial damping oscillation circuit with an electric charge within the corresponding second capacitor $C_2$ as a damping source. Consequently, a plasma flame gas is produced within the discharge cavity 4 of the first plasma ignition plug $P_1$ as an arcing product and the plasma gas is injected through the jet hole 5 shown in FIG. 1 into the corresponding combustion chamber of the first cylinder to fire the compressed air-fuel mixture.

Figure 6:
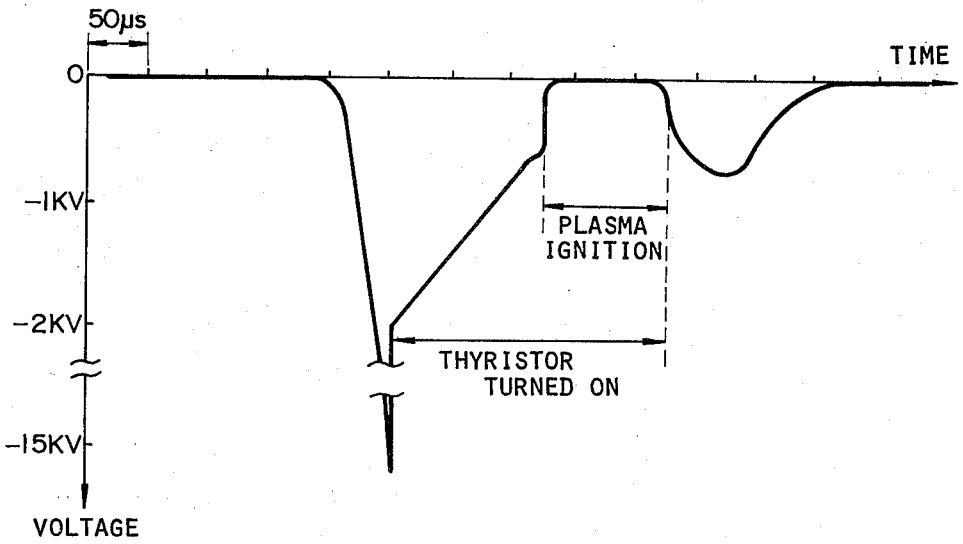
FIG. 6 shows a voltage waveform applied across one of the plasma ignition plugs in FIG. 3(A) when the temperature within the plasma ignition plug is excessively raised.

In the case when a decreasing rate of voltage drop across the first plasma ignition plug $P_1$ after the occurrence of the spark discharge is gradual from about minus 2 kilovolts to minus 500 volts with respect to the grounded side electrode 2 as shown in FIG. 6 due to an excessive rise in temperature of the ignition plug $P_1$ itself, the first thyristor 11*a* needs to be held in the turned-on state until the voltage drop between both central and side electrodes 1 and 2 of the first plasma ignition plug $P_1$ is positively higher than about minus 1000 volts in order to discharge the corresponding second capacitor $C_2$.

In this case, a current based on the electric charge within the first capacitor $C_1$ of the auxiliary circuit 15 is passed through the main circuit of the first thyristor 11*a* (anode to cathode) which is presently turned on via the resistor R into the ground so that the first thyristor 11*a* is held in the turn-on state during a predetermined interval of time (i.e., the time constant determined by the first capacitor $C_1$ and resistor R). The timing at which the current described above starts to flow is at the same time when the first thyristor 11*a* is turned on and the DC-DC converter 10' receives the halt signal 19*a* from the second monostable multivibrator 19. That is to say, if each proper value of the first capacitor $C_1$ and resistor R is set (e.g., $C_1$=0.07 microfarads and R=100 ohms), a holding current of approximately 50 milliseconds can be sent into the first thyristor 11*a* during an interval of time of 200 microseconds. During the time interval of 200 microseconds, the voltage drop between both central and side electrodes 1 and 2 reaches substantially minus 1000 volts or positively higher than minus 1000 volts, so that the high energy can be supplied into the first plasma ignition plug $P_1$ via the thyristor 11*a* which is held in the turn-on state and the corresponding oil L. Such a feature can be appreciated from a voltage curve shown in FIG. 6.

Figure 5:
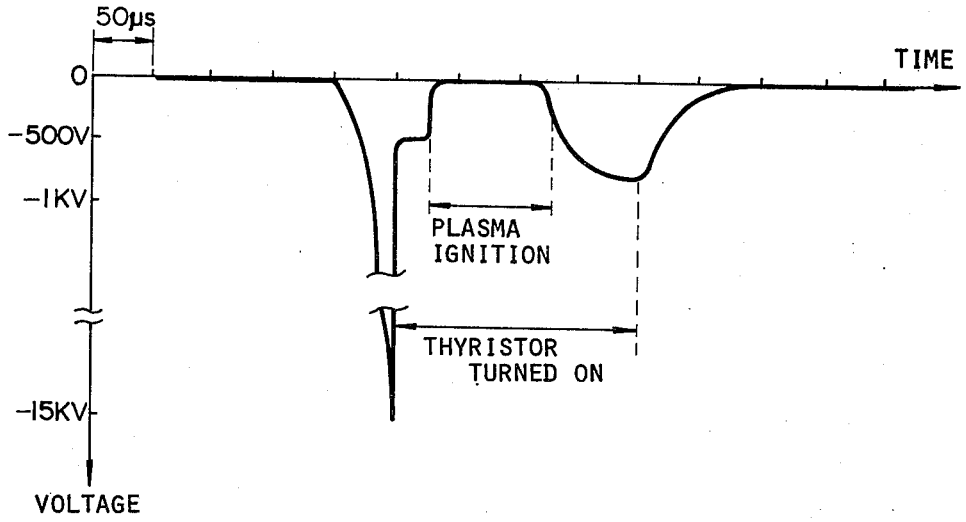
FIG. 5 shows a voltage waveform applied across one of the plasma ignition plugs in FIG. 3(A) when a temperature within the plasma ignition plug is not excessively raised.

In addition, the halt signal 19*a* is sent from the second monostable multivibrator 19 to the DC-DC converter 10' to halt the oscillation of the DC-DC converter. The halt inteval of time of the DC-DC converter 10' depends on the width (1 milisecond) of the halt pulse signal 19*a* and is longer than the interval of time during which the first thyristor 11*a* turns on, so that the thyristor 11*a* returns to the turn-off state after sufficiently discharging the second capacitor $C_2$. Since the thyristor 11*a* through 11*d* and corresponding second capacitor $C_2$ is provided for each cylinder, the unmatched discharge due to the application of the electric charge energy to the other plasma ignition plugs which are presently at any engine stroke other than the ignition timing can be prevented. The wasteful consumption of the energy from the DC-DC converter 10' to the first capacitor $C_1$ can be prevented because of the presence of the fourth diode $D_4$ of the auxiliary circuit 15. When the temperature of the first plasma ignition plug $P_1$ is normal and the decreasing rate of the voltage drop across the plug $P_1$ is rapid as compared with the case shown in FIG. 6, the first thyristor 11*a* is held in the turn-on state during the same interval of time as that shown in FIG. 6. Such a feature as described above can be appreciated from FIG. 5.

As described hereinbefore, since a plasma ignition system according to the present invention is provided with the auxiliary circuit for keeping each thyristor turned on during a period of time which is long enough to supply the plasma ignition energy into the corresponding plasma ignition plug, the discharge of each second capacitor can be completed even if a voltage drop to maintain plasma discharge subsequent to the spark discharge is not decreased rapidly toward zero due to an excessive rise in temperature of each plasma ignition plug. In addition, since the thyristor and second capacitor are provided for each engine cylinder, the unmatched discharge described above can be prevented.

It will be fully understood by those skilled in the art that modifications may be made in the preferred embodiment described hereinabove without departing the spirit and scope of the present invention, which is to be defined by the appended claims.

What is claimed is:

1. A plasma ignition system for an internal combustion engine having a plasma ignition plug within each engine cylinder, which comprises:

(a) a low DC voltage supply;

(b) high surge voltage generating and distributing means which generates a high surge voltage on a basis of the low DC voltage from said low DC voltage supply and distributes the high surge voltage into one of the plasma ignition plugs according to a predetermined ignition order so as to generate a spark discharge at the plasma ignition plug;

(c) plasma ignition energy generating means which generates a high DC voltage on a basis of the low DC voltage from said low DC voltage supply so as to provide a plasma ignition energy for each plasma ignition plug;

(d) a plurality of plasma ignition energy charging means each connected to said plasma ignition energy generating means and each of which receives the high DC voltage generated from said plasma ignition energy generating means so as to charge the plasma ignition energy for a corresponding plasma ignition plug;

(e) a plurality of switching elements each connected to said plasma ignition energy generating means and each of which turns on in response to a trigger pulse inputted thereinto according to the predetermined ignition order so as to apply the plasma ignition energy within said corresponding plasma ignition energy charging means across the corresponding plasma ignition plug; and (f) auxiliary turned on interval extending means, connected to said plasma ignition energy generating means in parallel with each of said switching elements, which extends the turned-on interval of time of each of said switching elements so as to fully discharge the plasma ignition energy within one of said plasma ignition charging means into the corresponding plasma ignition plug, whereby the plasma ignition can securely be carried out at each plasma ignition plug.

2. A plasma ignition system as set forth in claim 1, wherein said switching elements are thyristors and said auxiliary turned-on interval extending means comprises:

(a) a capacitor connected in parallel with said plasma ignition charging means to said plasma ignition energy generating means which receives and charges the high DC voltage outputted from said plasma ignition energy generating means when said thyristors are turned off; and (b) a resistor connected between said capacitor and each of said thyristors which provides a means for passing a discharge current from said capacitor to one of said thyristors which is turned on with a predetermined time constant so as to extend the turned-on interval of time of said thyristor, said discharge current being greater than a holding current for keeping the thyristor turned on.

3. A plasma ignition system for an internal combustion engine having a plasma ignition plug within each engine cylinder, which comprises:

(a) a low DC voltage supply;

(b) a high surge voltage generating and distributing means, connected to said low DC voltage supply, for generating and applying a high-peak surge voltage sequentially across one of the plasma ignition plugs according to a predetermined ignition order of the related engine cylinder so as to generate a spark discharge at the plasma ignition plug;

(c) a DC-DC converter, connected to said low DC voltage supply, which oscillates the low DC voltage into a corresponding AC voltage, boosts the AC voltage and converts the boosted AD voltage into a high DC voltage;

(d) a plurality of plasma ignition energy charging means connected to said DC-DC converter and across each of which the high DC voltage outputted from said DC-DC converter is applied for charging a plasma ignition energy for a related plasma ignition plug therewithin;

(e) a plurality of thyristors, each connected to one of said plasma ignition energy charging means, for operatively connecting the plasma ignition energy charging means to the corresponding plasma ignition plug so as to feed the high DC voltage which is charged within the plasma ignition energy charging means into the corresponding plasma ignition plug therethrough;

(f) a trigger pulse generating means which generates and outputs a first trigger pulse sequentially into the gate terminal of one of said thyristors so as to turn on said thyristor according to the predetermined ignition order of the related engine cylinder and also outputs a second trigger pulse into said DC-DC converter so as to halt the oscillation of said DC-DC converter to discontinue the high DC voltage from outputting from said DC-DC converter whenever said first trigger pulse is outputted, the pulsewidth of said second trigger pulse being longer than that of said first trigger pulse;

(g) a plurality of inductive means each connected between said corresponding plasma ignition charging means and plasma ignition plug for producing a damped oscillation on a basis of the high DC voltage discharged from said corresponding plasma ignition energy charging means when said corresponding thyristor is turned on; and (h) an auxiliary charging and discharging means, connected to said DC-DC converter in parallel with each of said plasma ignition energy charging means, which receives the high DC voltage from said DC-DC converter and discharges the high DC voltage with a predetermined time constant into one of said thyristors which is presently turned on in response to said second trigger pulse from said trigger pulse generating means for extending said thyristor in the turned-on state for an interval of time determined by the predetermined time constant after the spark discharge occurs at the related plasma ignition plug so as to securely generate a subsequent plasma hightemperature gas thereat by the discharge of the plasma ignition energy, whereby a complete ignition for a compressed air-fuel mixture can be achieved within the corresponding engine cylinder.

4. A plasma ignition system as set forth in claim 3, wherein said auxiliary charging and discharging means comprises:

(a) a first diode connected to said DC-DC converter;

(b) a second diode connected to said first diode;

(c) a second capacitor, connected to said second diode, for receiving and charging the high DC voltage through said first and second diodes; and (d) a resistor connected across said second diode for providing a resistive passage of the high DC voltage discharge from said second capacitor into one of said thyristors which is turned on in response to said first trigger pulse from said trigger pulse generating means.

5. A plasma ignition system as set forth in claim 3, wherein said high surge voltage generating and distributing means comprises:

(a) a transformer having a common terminal of both primary and secondary windings and the other terminal of the primary winding being connected to said low DC voltage supply;

(b) a switch connected between the common terminal of said transformer and ground which repetitively opens at a speed in synchronization with the engine rotation; and (c) a distributor having a rotor which rotates in synchronization with the engine rotation and a plurality of fixed contacts located at equal interval of distances with each other so as to come in contact with said rotor at the respective ignition timings and each connected to the corresponding plasma ignition plug, and said trigger pulse generating means comprises:

(a) a sensor which detects the engine rotation and outputs a third pulse at each ignition timing whose period is determined depending on the number of engine cylinders in synchronization with the engine rotation and a fourth pulse whose period corresponds to one engine cycle.

(b) a multi-bit ring counter which circularly outputs a fifth pulse whenever the third pulse from said sensor is received and is reset by the fourth pulse from said sensor the pulsewidth of each fifth pulse being equal to the period of said third pulse;

(c) a plurality of first monostable multivibrators each connected to said multi-bit ring counter and each of which outputs the first trigger pulse to said corresponding thyristor whenever the corresponding fifth pulse is received from said multi-bit ring counter; and (d) a second monostable multivibrator connected to said DC-DC converter, which outputs the second trigger pulse in response to said third pulse from said sensor.

* * * * *